United States Patent [19]

Diacont, Jr.

[11] 4,279,209

[45] Jul. 21, 1981

[54] APPARATUS FOR HOLDING AND UNFOLDING BELT LOOP

[75] Inventor: George P. Diacont, Jr., Richmond, Va.

[73] Assignee: AMF Incorporated, White Plains, N.Y.

[21] Appl. No.: 186,072

[22] Filed: Sep. 11, 1980

[51] Int. Cl.[3] ..... D05B 3/12

[52] U.S. Cl. ..... 112/104; 112/121.27; 112/262.3; 112/265.1

[58] Field of Search ..... 112/121.27, 121.26, 112/104, 262.1, 262.3, 265.1, 113, 114

[56] References Cited

U.S. PATENT DOCUMENTS

| | | | |
|---|---|---|---|
| 3,699,907 | 10/1972 | Anderson et al. | 112/104 X |
| 3,841,247 | 10/1974 | Off et al. | 112/104 X |
| 4,114,544 | 9/1978 | Miyachi et al. | 112/121.27 X |
| 4,137,857 | 2/1979 | Miyachi et al. | 112/121.27 |

*Primary Examiner*—H. Hampton Hunter

*Attorney, Agent, or Firm*—George W. Price; Charles J. Worth

[57] ABSTRACT

A method of holding and unfolding a drop type belt loop while it is being stitched to the waist band of a garment and the apparatus for accomplishing the same.

11 Claims, 6 Drawing Figures

APPARATUS FOR HOLDING AND UNFOLDING BELT LOOP

BACKGROUND OF THE INVENTION

This invention relates generally to tack type sewing machines for attaching belt loops to garments and more particularly to the method and apparatus associated with such machines for positioning and holding such loops and garments during the stitching operations.

Belt loops are normally sewn to garments in two ways, both being difficult and time consuming. Belt loops sewn on casual or work cloths, such as dungarees or jeans have both ends folded under with visible stitching through both folded ends. Dress and more formal clothing have drop type belt loops wherein the upper end is stitched to the garment and the loop is folded over covering the stitched end. The other or bottom end of the loop is folded under and sewn to the garment with visible stitching through the folded end. The present invention is directed to stitching such drop loops.

Belt loops may be made as a ribbon-like preform stored on a spool for future use by cutting the ribbon into discrete lengths, the desired lengths of the loops to be stitched to a garment. Alternatively, belt loops may be made at the time they are stitched or tacked on to garments.

The present invention can be used with belt loops which have been stored or concurrently made and contemplates the use of a belt loop folder/feeder providing prefolded belt loops which are folded substantially in half with the bottom end folded under so that the top end of the loop extends past the folded under end and is exposed.

An object of the present invention is to provide an improved method of stitching drop type belt loops to garments and the apparatus for accomplishing the same.

Another object of the present invention is to provide the foregoing novel method and apparatus which is particularly adapted for automatic operation.

Still another object of the present invention is to provide the foregoing apparatus which positively grips and positions a drop type belt loop and the garment to which the belt loop is to be sewn during the stitching operation.

And another object of the present invention is to obviate the necessity of folding a drop type belt loop during the stitching operation.

The foregoing and other objects and advantages will appear more fully hereinafter from a consideration of the detailed description which follows, taken together with the accompanying drawings wherein a single embodiment of the invention is illustrated by way of example. It is to be expressly understood, however, that the drawings are for illustration purposes only and are not to be construed as defining the limits of the invention.

From the following description one skilled in the art will readily understand that various types of control systems programmed to sequentially operate a plurality of motors in a predetermined manner can be utilized with the novel apparatus. Accordingly, the control system per se forms no part of the present invention which, in actuality, is directed to an entirely new concept for attaching drop type belt loops and the simplified apparatus for accomplishing the same.

Figure 1:
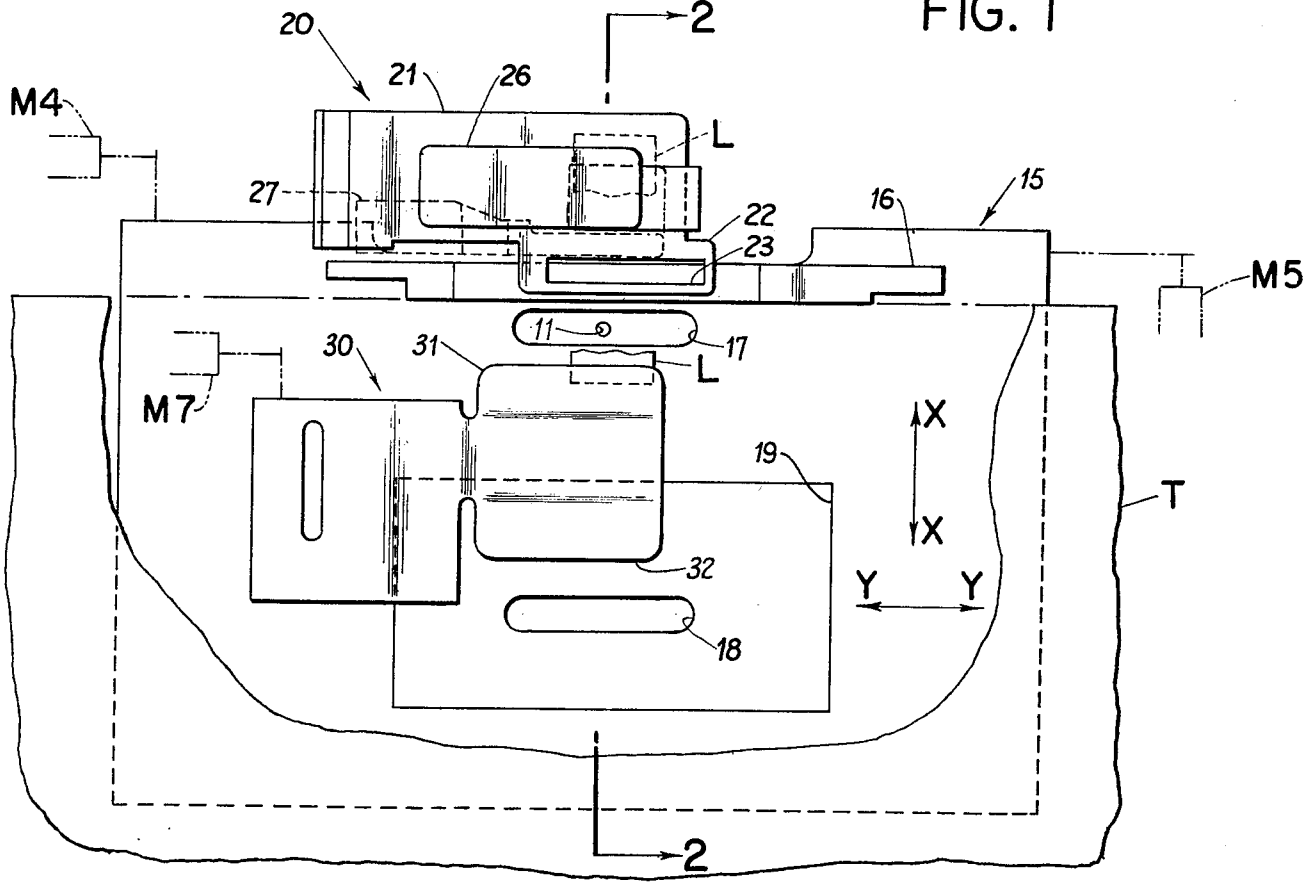
FIG. 1 is a plan view diagrammatically illustrating the present invention.
Figure 2:
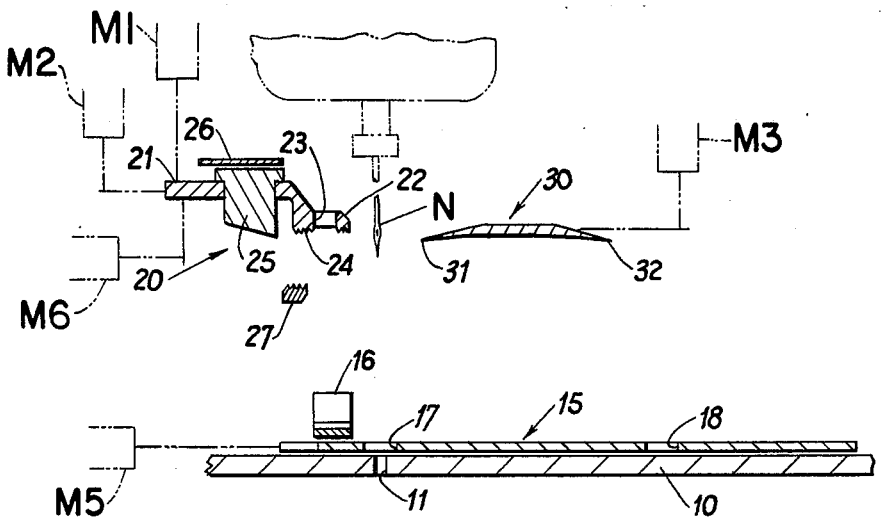
FIG. 2 is a sectional view taken on line 2—2 of FIG. 1.

Referring now to the drawings and particularly to FIGS. 1 and 2, the novel apparatus is shown in a quiescent position preparatory for receiving a prefolded belt loop from a folder/feeder. A feed plate 15 is movably supported on the bed or table 10 of a tacker type sewing machine which has the usual hole 11 for the needle N which is driven by the usual mechanism in the sewing machine head 12. In addition to a locator member 16 which provides an abutment or stop for the waist band of a garment T, the feed plate 15 is provided with a pair of slots 17 and 18 which extend along the lateral axis Y—Y and are spaced from each other along the longitudinal axis X—X. The slot 17 is aligned with the needle opening 11 for tacking the upper end LU of a belt loop L while the slot 18 will be aligned with the needle opening for tacking the lower end LL of the belt loop. To accomodate belt loops of different length, the feed plate 15 may be provided with a replaceable or adjustable insert as indicated at 19 to provide the appropriate longitudinal spacing between slots 17 and 18.

A stabilizer plate 30 with longitudinally spaced clamp or control edges 31 and 32 is spaced above the feeder plate 15 between the slots 17 and 18. A clamp means 20 with spaced apart upper and lower jaws 21 and 27 is longitudinally spaced rearwardly from the stabilizer plate 30 and is spaced above the rear edge of the feed plate 15. The upper jaw 21 is provided with a nose portion 22 with a laterally extending slot 23 generally similar in size to the slots 17 and 18, and a bottom surface providing a gripping face 24. The upper jaw 21 is also provided with a retainer 25 which is biased downwardly by a spring 26.

Figure 3:
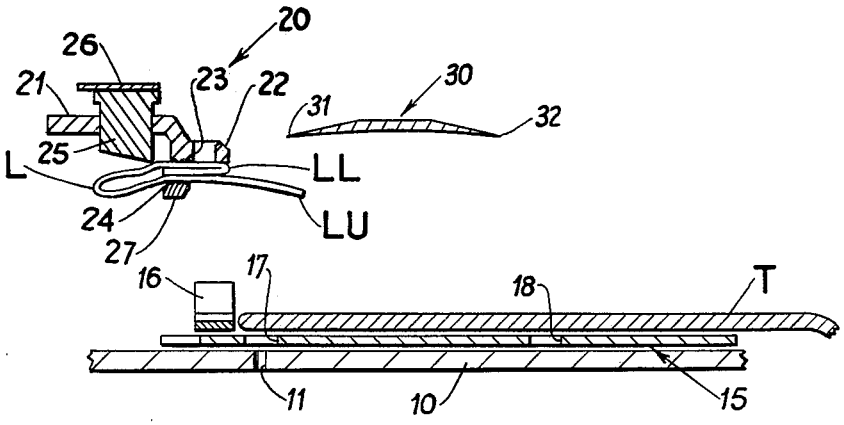
FIGS. 3 to 6 are views similar to FIG. 2 illustrating the progression of movement of the novel apparatus from the time a prefolded belt loop is received to final tacking in accordance with the present invention.
Figure 4:
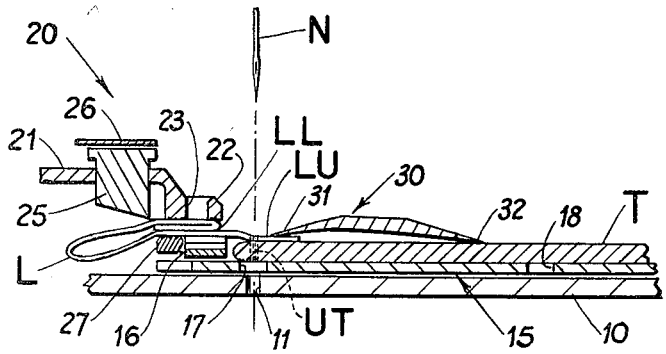

The operator now positions the garment T on the feed plate 15 with the edge of the waist band abutting the stop or locator bar 16 as best shown in FIGS. 1 and 3, and the automatic cycle or operations can be initiated. It should be noted that only the various motors M1 to M7 for operating the apparatus of a suitable automatically sequencing control system are diagrammatically indicated only in FIGS. 1 and 2 of the drawings. As best shown in FIG. 3, the prefolded belt loop L is essentially folded in half with the top portion of the fold having the folded under lower loop end LL and the bottom portion of the fold including the upper loop end LU which extends past the lower loop end and is, therefore, exposed.

The operator causes the folder/feeder (not shown) to present a prefolded belt loop L to the clamp means 20 and, upon initiation of the automatic control, the motor M1 moves the upper jaw 21 downward against the lower jaw 27 to clamp the belt loop L therebetween, as shown in FIG. 3. It should be noted that the retainer 25 also engages the folded loop L.

The motor M2 then moves the clamp means 20 (upper jaw 21, lower jaw 27) and the stabilizer plate 30 in unison downwardly until the upper jaw 21 urges the folded loop L against the locator bar 16 which is at least in part a spring member which is loaded by such engagement. A motor M3 further moves stabilizer plate 30 downwardly so that the edge 31 clamps the upper loop end LU adjacent the slot 17 on the opposite sides from the clamping action between the nose portion 22 of jaw 21 and the locator bar 16. It should be noted that at this time the nose portion 22 of the upper jaw 21 and the edge 31 of stabilizer plate 30 define a laterally extending slot aligned with slot 17 of plate 15. Movement of plate 30 by motor M3 also urges the edge 32 to clamp the waist band of the garment T against the feed plate 15 a distance longitudinally spaced from the clamping action of the edge 31, as shown in FIG. 3. A motor M4 now moves the feed plate 15, the clamp means 20 and the stabilizer plate 30 in unison laterally so the needle N will stitch UT across the full width of the belt loop L. It should be understood the sewing machine or tacker is arranged to stop only when the needle N is removed from the material being stitched.

Figure 5:
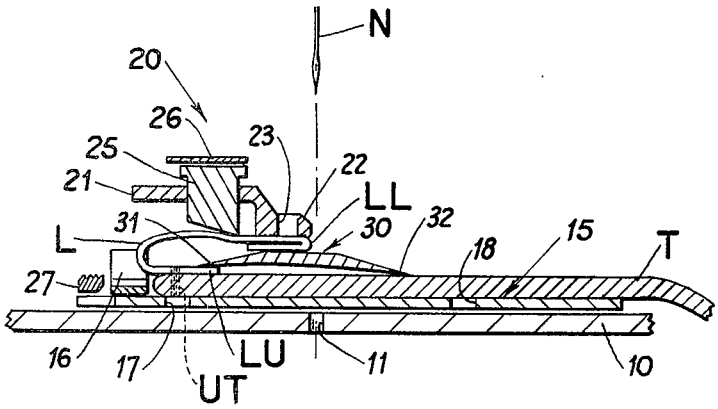
Figure 6:
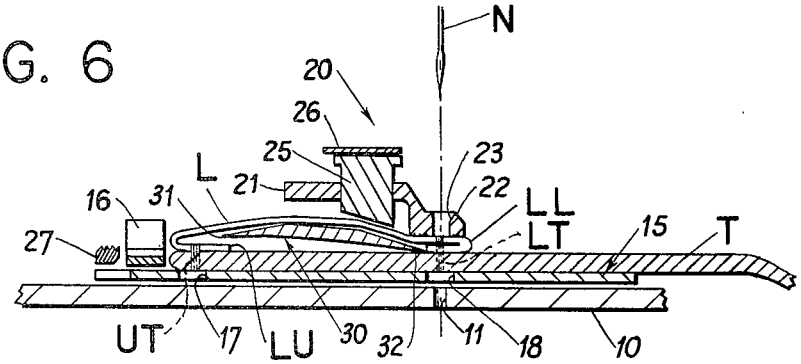

When the tacking UT of the upper end LU of loop L to the garment T is completed, the motor M1 will release the upper jaw 21 of clamp means 20 and simultaneously, motor M5 will move feed plate 15 and stabilizer plate 30 rearwardly and motor M6 will move the upper jaw 21 forwardly causing the lower loop end LL to travel across plate 30 as shown in FIG. 5 until the slot 23 of the nose portion 22 of upper jaw 21 and slot 18 of the feed plate are aligned with each other, the needle N and the needle hole 11 in the machine bed 10, as shown in FIG. 6. In effect, the loop ends LU and LL are moved longitudinally away from one another unfolding loop L across the stabilizer plate 30 which finally is merely folded over the upper loop end LU covering the stitching or tack UT. At this point in time, the motor M4 will again move the feed plate 15, clamp means 20 and stabilizer plate 30 laterally so the needle N can provide stitching LT through the folded under loop end LL across the full width of the loop L. It should be noted that the upper stitching UT is hidden by the loop L while the lower stitching LT is visible.

At the termination of stitching LT, the motor M3 will unload the plate 30, permitting a motor M7 to laterally withdraw the stabilizer plate 30 from under the tacked loop L, and motors M2, M5 and M6 will return the feed plate 15, the clamp means 20 and the stabilizer plate 30 to their original quiescent positions as shown in FIGS. 1 and 2. The operator can then manually reposition the garment T preparatory to applying the next belt loop.

Although a single embodiment of the invention has been illustrated and described in detail, it is to be expressly understood that the invention is not limited thereto. Various changes may be made in the design and arrangement of the parts without departing from the spirit and scope of the invention as the same will now be understood by those skilled in the art.

What is claimed is:

1. A method of sewing a drop type belt loop on to a garment comprising the steps of positioning a garment to receive a belt loop;

providing a folded belt loop with the top fold having a folded under lower loop end and the bottom fold having an exposed upper loop and extending past the folded under lower loop ends;

positioning the belt loop with the exposed upper loop and overlying a predetermined portion of the garment;

clamping the upper loop end with the garment therebeneath and further clamping the garment at a distance longitudinally spaced from the upper loop end adjacent to the portion of the garment to which the lower loop end is to be tacked;

moving the belt loop and garment laterally in unison when tacking the upper loop end to the garment;

moving the garment and lower loop end relative to one another longitudinally thereby positioning the lower loop end adjacent to where the garment is further clamped; and again moving the belt loop and garment laterally in unison when tacking the lower loop end to the garment.

2. The method in accordance with claim 1 further comprising the step of providing a stabilizer plate having a pair of longitudinally spaced edges which clamp the upper loop end and garment;

the stabilizer plate providing a surface traversed by the lower loop end in response to relative longitudinal movement of the lower loop end and garment, and remaining in position within the loop until the lower loop end has been tacked to the garment.

3. The method in accordance with claim 2 further comprising the step of providing jaw means for receiving and positioning the folded belt loop and for moving the lower loop end longitudinally to a position to be tacked.

4. A method of sewing a drop type belt loop to a garment comprising the steps of providing a movable feed plate on the bed with a needle hole of a tacker type sewing machine;

positioning a garment on the feed plate;

providing a folded belt loop with the top fold having a folded under lower loop end and with the bottom fold having an exposed upper loop end extending past the lower loop end;

positioning the exposed upper loop end on the garment overlying the needle hole in a first tacking position;

clamping the upper loop end and the garment therebeneath against the feed plate and further clamping the garment against the feed plate a longitudinally spaced distance from the upper loop end moving the belt loop and garment in unison laterally while tacking the upper loop end to the garment;

moving the lower loop end and garment longitudinally relative to each other to a second tacking position with the lower loop end on the garment adjacent to where it is further clamped and overlying the needle hole; and again moving the belt loop and garment in unison laterally while tacking the lower loop end to the garment.

5. The method in accordance with claim 4 further comprising the step of providing a stabilizer plate having a pair of longitudinally spaced edges;

one of said pair of edges clamping the upper loop end and the garment therebeneath while the other of said pair of spaced edges further clamps the garment.

6. The method in accordance with claim 5 in which the lower loop end is spaced from the one of said pair of edges in the first tacking position and is adjacent to the other of said edges in the second tacking position; and said stabilizer plate providing a contact surface for the lower loop end moving from the first to the second tacking position.

7. In combination with a tacker type sewing machine having a bed with a needle hole, apparatus for tacking a drop type belt loop to a garment comprising a feed plate adapted to receive a garment and having a pair of longitudinally spaced laterally extending slots being movably mounted on said bed for aligning each of said slots with the needle hole in a different tacking position;

clamp means spaced above said bed and having a pair of jaws adapted to receive and hold a folded belt loop with the top fold having a folded under lower loop end and the bottom fold having an exposed upper loop end extending past the lower loop end;

said clamp means being movable toward said bed for positioning said exposed upper loop end on a garment and overlying one of said slots aligned with the needle hole;

a stabilizer plate spaced above said feed plate and having a pair of longitudinally spaced edges and means for moving said stabilizer plate toward said bed until one of said edges clamps the upper loop end and the garment therebeneath adjacent one of said slots against said feed plate and the other of said edges clamps the garment adjacent the other of said slots against said feed plate;

said feed and stabilizer plates and clamp means being movable laterally in unison for moving said belt loop and garment laterally when tacking the upper loop end to the garment;

said feed and stabilizer plates and one of said jaws being movable to move the garment and lower loop end longitudinally in opposite directions relative to one another to align said other of said slots with the needle hole and to position the lower loop end over said other of said slots; and said feed and stabilizer plates and clamp means being movable laterally in unison for again moving the belt loop and garment laterally when tacking the lower loop end to the garment.

8. The apparatus in accordance with claim 7, and said stabilizer plate providing a contact surface for said lower loop end being positioned over said other of said slots.

9. The apparatus in accordance with claim 8, and said stabilizer plate remaining within the belt loop with its edges clamping the upper loop end and garment against said feed plate until both the upper and lower loop ends are tacked to the garment.

10. The apparatus in accordance with claim 9, and said upper jaw having a nose portion with an edge spaced from said one of said edges of said stabilizer plate to form a slot aligned with said one of said slots of said feed plate, and a laterally extending slot aligned with the other of said slots of said feed plate when the lower loop end is positioned for tacking.

11. The apparatus in accordance with claim 10, and said jaws of said clamping means having opposed gripping faces for engaging opposite sides of the folded belt loop; and the upper jaw having a spring biased retainer engaging the top fold of the belt loop to prevent slippage when the lower loop end is moved longitudinally.

* * * * *